US005979005A

United States Patent [19]

Lecce

[11] Patent Number: 5,979,005

[45] Date of Patent: Nov. 9, 1999

[54] TOOTHBRUSH APPARATUS

[76] Inventor: Frank A. Lecce, 28 Buckingham La., West Hartford, Conn. 06117

[21] Appl. No.: 08/950,194

[22] Filed: Oct. 14, 1997

[51] Int. Cl.[6] ..... A46B 9/04

[52] U.S. Cl. ..... 15/167.1; 15/143.1; D4/104; D4/110

[58] Field of Search ..... 15/143.1, 167.1; D4/104, 110, 112, 138

[56] References Cited

U.S. PATENT DOCUMENTS

| | | | |
|---|---|---|---|
| D. 233,961 | 12/1974 | Crawford | D4/110 |
| D. 300,990 | 5/1989 | Jagger | D4/104 |
| D. 397,873 | 9/1998 | Lecce | D4/110 |
| 2,405,029 | 7/1946 | Gallanty et al. | 15/167.1 |
| 2,978,724 | 4/1961 | Gracian | 15/143.1 |
| 4,654,921 | 4/1987 | Dinner | 15/167 R |
| 5,078,732 | 1/1992 | Ceniceros | 606/235 |
| 5,287,584 | 2/1994 | Skinner | 15/167.1 |
| 5,511,273 | 4/1996 | Carroll | 15/105 |
| 5,530,983 | 7/1996 | Maltese | 15/160 |
| 5,623,739 | 4/1997 | Thompson | 15/167.1 |

*Primary Examiner*—Krisanne Thornton
*Attorney, Agent, or Firm*—Robert S. Smith

[57] ABSTRACT

A toothbrush having a curvilinear open loop shaped handle that extends through an arc of approximately 270 degrees. The handle of this toothbrush also includes a head disposed at one end thereof. The head has a plurality of bristles extending radially outwardly from the center of said open loop shape handle. In some forms of the invention the toothbrush is dimensioned and configured such that an imaginary square having all sides equal extends around the toothbrush will substantially abut the free end of the bristles on one side thereof and portions of the curvilinear handle on the other three sides of said imaginary square.

1 Claim, 2 Drawing Sheets

TOOTHBRUSH APPARATUS

BACKGROUND OF THE INVENTION

The invention relates to dental care apparatus and particularly to apparatus for brushing teeth. The prior art includes a very wide variety of apparatus for brushing teeth. U.S. Design Pat. No. 324,958 discloses a toothbrush having an elongated closed loop shaped handle. The user may press one elongated side of the handle towards another elongated side of the handle to change the inclination of a head on which the bristles are located. U.S. Pat. No. 3,214,776 discloses a mechanically operable toothbrush having a U-shaped handle. The user squeezes the opposed elongated legs of the U-shaped handle and the free end of one of the length is coupled to an eccentric member coupled to a shaft on which the bristles are mounted. In this manner the shaft is caused to alternately rotate clockwise and counter clockwise.

U.S. Pat. No. 2,273,207 discloses a toothbrush having and elongated handle. The inventor there and suggests that the conventional orientation of the bristles along the axis of the handle requires movement of the brush to an awkward angle. Accordingly the inventor provides two sets of bristles which are each offset from the axis of the handle whereby the user may brush both the upper and lower teeth simultaneously.

U.S. Design Pat. No. 122,815 discloses a combine toothbrush and tongue cleaner. The structure includes a closed loop of material that 5 substantially coplanar with a plane to which all of the bristles are perpendicular.

U.S. Design Pat. No. 358,259 discloses a scalp brush having a substantially arc shaped handle with a generally tangential head from which all of the bristles extend. U.S. Design Pat. No. 282,413 discloses a toothbrush having a generally J-shape handle. A head from which all of the bristles extend in perpendicular relationship is disposed in normal relationship to end of the handle nearest to the curved part or foot part thereof.

U.S. Designed Pat. No. 358,206 discloses a toothbush having an arc shaped handle. Bristles extend from one end thereof generally radially outwardly. U.S. Pat. No. 5,272,784 discloses a toothbrush, having a handle similar to a conventional toothbrush except that several elongated openings are provided within the handled to minimize the possibility of the handle being sharpened into a weapon.

U.S. Pat. No. 5,138,737 discloses a toothbrush having two closed loops within the handle. A common part of each of the loops is generally aligned with a set of bristles. U.S. Pat. No. 4,654,921 also discloses a closed loop handle having a spur extending from the loop. Bristles project From the spur.

While the loop shaped structure of U.S. Pat. No. 4,654,921 may be satisfactory for some applications such as the recited young child or infant it is not particularly suitable for use by adults.

It is an object of the present invention to provide apparatus which will enable the user to comfortably and easily control the toothbrush while briskly brushing the teeth.

Still another object of the invention is to provide such apparatus which can be manufactured at substantially no increase in manufacturing cost over conventional structures.

SUMMARY OF THE INVENTION

It has now been found that these and other objects of the invention may be attained in a toothbrush having a curvilinear open loop shaped handle that extends through an arc of approximately 270 degrees. The handle of this toothbrush also includes a head disposed at one end thereof. The head has a plurality of bristles extending radially outwardly from the center of said open loop shape handle.

In some forms of the invention the toothbrush is dimensioned and configured such that an imaginary square having all sides equal extends around the toothbrush will substantially abut the free end of the bristles on one side thereof and portions of the curvilinear handle on the other three sides of said imaginary square.

BRIEF DESCRIPTION OF THE DRAWING

The invention will be better understood by reference to the accompanying drawing in which.

DESCRIPTION OF THE PREFERRED EMBODIMENT

Figure 3:
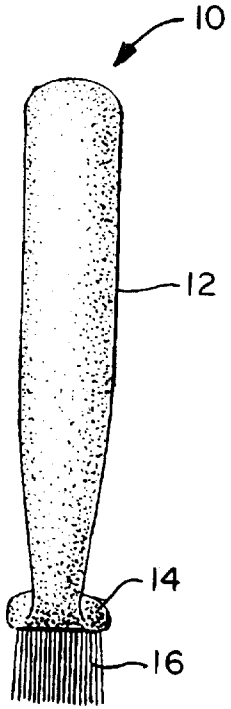
FIG. 3 is a rear elevational view of the apparatus shown in FIG. 1.

Referring now to FIGS. 1–6 there is shown a toothbrush in accordance with one form of the present invention. The toothbrush 10 includes a open loop shaped handle 12. Stated another way the handle 12 is cuvilinear and extends through an arc of approximately 270 degrees. Some forms of the invention may have a handle 12 that is truly arc shaped. That is, the shape may be a part of a circle although the shape need not be truly arcuate in all forms of the present invention. As will be apparent from the drawings, the preferred embodiment has a handle 12 that is cuvilinear although it is not literally arcuate.

The handle includes at one axial extremity a head 14. The head 14 is substantially planar and disposed in what approaches a tangential relationship to the rest of the handle 12. A plurality of bristles 16 extend in generally perpendicular relationship to the planar head 14.

Figure 1:
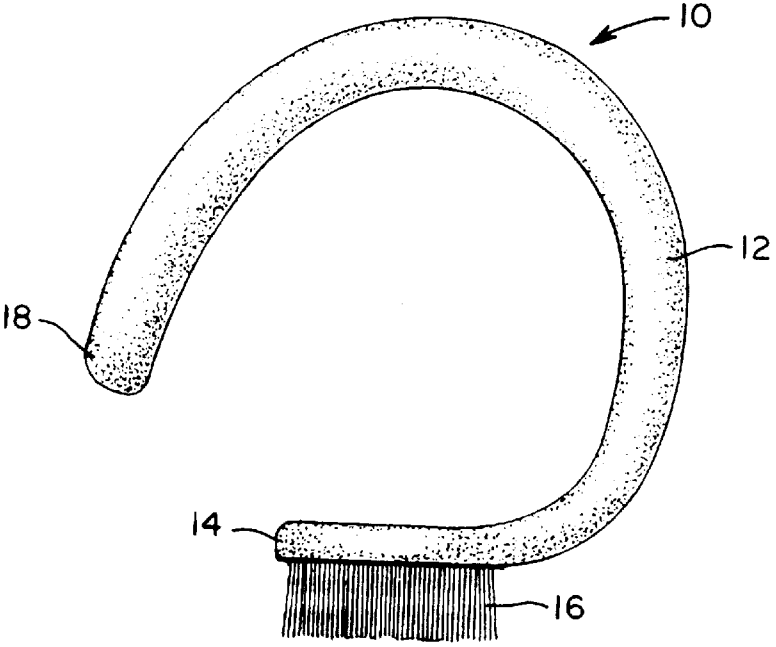
FIG. 1 is a side elevational view of one form of the toothbrush in accordance with the present invention.
Figure 2:
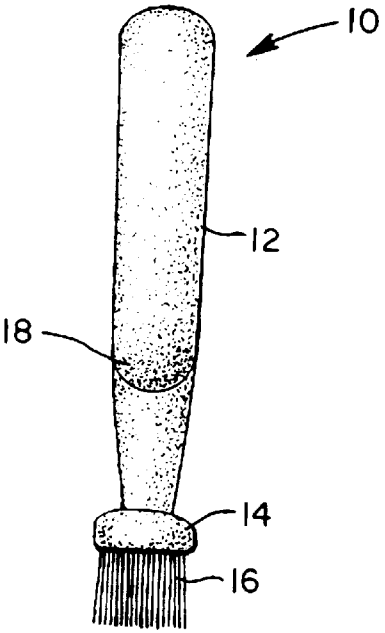
FIG. 2 is a front elevational view of the apparatus shown in FIG. 1.
Figure 4:
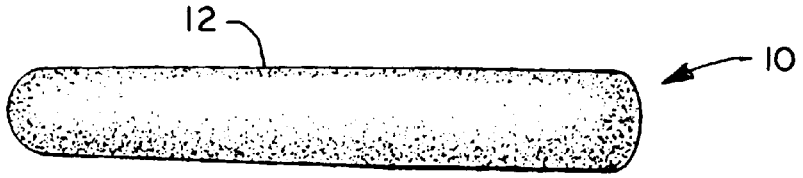
FIG. 4 is a top view of the apparatus shown in FIG. 1.
Figure 5:
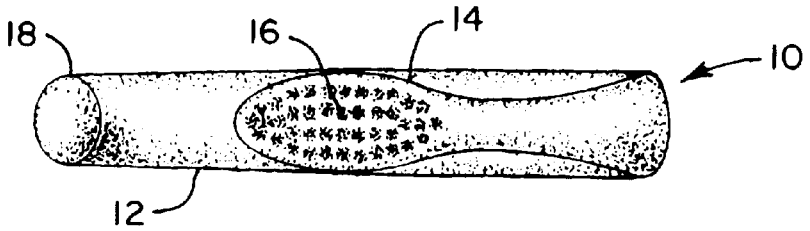
FIG. 5 is a bottom view of the apparatus shown in FIG. 1.
Figure 6:
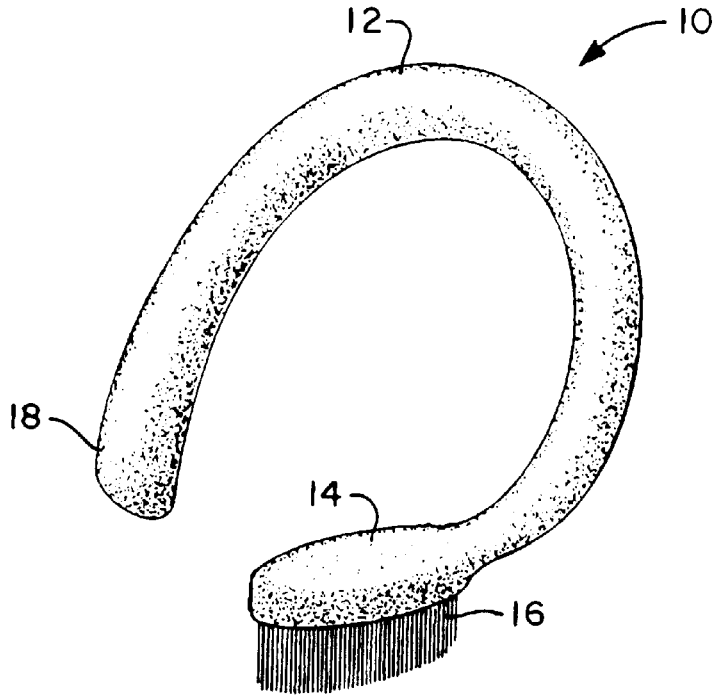
FIG. 6 is a perspective view of the apparatus shown in FIG. 1.

In the preferred embodiment the toothbrush 10 will fit substantially within an envelope that is substantially a square. In other words the width of the toothbrush 12 and the height of the toothbrush 12, as best seen in FIG. 1, are substantially equal and when the free ends of the bristles 16 contact one side of an imaginary square, the other parts of the handle will substantially contact the three other sides of an imaginary square. (The term square refers, of course to a rectangle that has four sides of equal length.)

The shape of the handle 12 of the toothbrush 10 is particularly advantageous in that a user may circle the part of the handle 12 that is opposite to the head 14 with four fingers and place his thumb against the other end 18 of of the handle 12. As will be apparent from the drawings the other end 18 is the other axial extremity of the handle 12. In other words the handle has a head 14 at one end and has another end 18.

This geometric relationship enables the user to firmly grasp the handle 12 and briskly brush the teeth. The open loop shape of the handle allows movement of the head 14 along the sides of the molars and wisdom teeth of the user without interference with the cheeks of the user, while still allowing the user to firmly grip the handle 12.

The invention has been described with respect to its illustrated preferred embodiments. Persons skilled to the in the art of such devices may upon exposure to the teachings herein conceive other variations. Such variations are deemed to be encompassed by the disclosure, the invention in the delimited only by the following claims.

I claim:

1. A toothbrush having a curvilinear open loop shaped handle that extends through an arc of approximately 270 degrees and said handle includes a head disposed at one end thereof, said head having a plurality of bristles extending radially outwardly from the center of said open loop shape handle, said toothbrush is dimensioned and configured such that an imaginary square having all sides of equal length extending around said toothbrush will substantially abut the free end of the bristles on one side thereof and portions of said curvilinear handle on the other three sides of said imaginary square.

* * * * *